US008838442B2

(12) United States Patent
Terriberry et al.

(10) Patent No.: US 8,838,442 B2
(45) Date of Patent: Sep. 16, 2014

(54) METHOD AND SYSTEM FOR TWO-STEP SPREADING FOR TONAL ARTIFACT AVOIDANCE IN AUDIO CODING

(75) Inventors: Timothy B. Terriberry, Mountain View, CA (US); Jean-Marc Valin, Montreal (CA)

(73) Assignee: Xiph.org Foundation

( * ) Notice: Subject to any disclaimer, the term of this patent is extended or adjusted under 35 U.S.C. 154(b) by 262 days.

(21) Appl. No.: 13/414,418

(22) Filed: Mar. 7, 2012

(65) Prior Publication Data

US 2012/0232909 A1 Sep. 13, 2012

Related U.S. Application Data

(60) Provisional application No. 61/450,060, filed on Mar. 7, 2011.

(51) Int. Cl.
*G10L 21/00* (2013.01)
*G10L 19/02* (2013.01)
*G10L 19/038* (2013.01)

(52) U.S. Cl.
CPC ..... *G10L 19/0212* (2013.01); *G10L 19/038* (2013.01)
USPC ..... 704/205; 704/500

(58) Field of Classification Search
CPC ..... G10L 19/03; G10L 19/038
See application file for complete search history.

(56) References Cited

U.S. PATENT DOCUMENTS 5,079,547 A 1/1992 Fuchigama et al.
5,778,339 A 7/1998 Sonohara et al.
5,845,241 A * 12/1998 Owechko ..... 704/203
5,960,388 A 9/1999 Nishiguchi et al.
5,983,172 A 11/1999 Takashima et al.
6,018,707 A 1/2000 Nishiguchi et al.
6,064,954 A 5/2000 Cohen et al.
6,463,097 B1 10/2002 Held et al.
6,567,777 B1 5/2003 Chatterjee
6,934,676 B2 * 8/2005 Wang et al. ..... 704/200.1
6,993,477 B1 * 1/2006 Goyal ..... 704/203
7,242,976 B2 7/2007 Minato
7,275,036 B2 9/2007 Geiger et al.

(Continued)

OTHER PUBLICATIONS

Valin, Jean-Marc, Timothy B. Terriberry, and Gregory Maxwell. "A full-bandwidth audio codec with low complexity and very low delay." Proc. EUSIPCO. 2009.*

(Continued)

*Primary Examiner* — Brian Albertalli
(74) *Attorney, Agent, or Firm* — Dergosits & Noah LLP; Todd A. Noah

(57) ABSTRACT

Embodiments are directed to an audio coding scheme implemented in a codec that eliminates birdie artifacts generated by transform coding methods. A frequency coefficient spreading method invertibly rotates a spectrum of coefficient values based on a defined rotation angle, The rotated spectrum is then quantized, and the rotation operation is then reversed so that a previously sparse spectrum (i.e., one with few non-zero values) becomes one that has many non-zero values. The method arranges the coefficients for a particular partition into a linear array and computes a gain factor for the partition. A rotation angle of between 0 and $\pi/4$ for successive pairs of coefficients of the linear array based on the gain factor is then derived. One or more rotation operations are then applied to successive pairs of coefficients in the linear array using a specific rotation angle and a stride length for each rotation operation.

22 Claims, 5 Drawing Sheets

(56) References Cited

U.S. PATENT DOCUMENTS

| | | | | |
|---|---|---|---|---|
| 7,343,287 | B2 * | 3/2008 | Geiger et al. | 704/230 |
| 7,447,631 | B2 | 11/2008 | Truman et al. | |
| 7,454,330 | B1 | 11/2008 | Nishiguchi et al. | |
| 7,483,836 | B2 | 1/2009 | Taori et al. | |
| 7,583,804 | B2 | 9/2009 | Suzuki et al. | |
| 7,630,882 | B2 | 12/2009 | Mehrotra et al. | |
| 7,761,290 | B2 | 7/2010 | Koishida et al. | |
| 7,979,271 | B2 | 7/2011 | Bessette | |
| 8,195,730 | B2 * | 6/2012 | Geiger et al. | 708/400 |
| 8,364,471 | B2 | 1/2013 | Yoon et al. | |
| 8,463,599 | B2 | 6/2013 | Ramabadran et al. | |
| 8,494,863 | B2 | 7/2013 | Biswas et al. | |
| 8,554,818 | B2 * | 10/2013 | Zhang et al. | 708/400 |
| 8,620,674 | B2 * | 12/2013 | Thumpudi et al. | 704/500 |
| 2005/0216262 | A1 | 9/2005 | Fejzo | |
| 2006/0031064 | A1 | 2/2006 | Liljeryd et al. | |
| 2007/0016405 | A1 | 1/2007 | Mehrotra et al. | |
| 2007/0040710 | A1 | 2/2007 | Tomic | |
| 2007/0063877 | A1 | 3/2007 | Shmunk et al. | |
| 2007/0211804 | A1 | 9/2007 | Haupt et al. | |
| 2007/0282603 | A1 | 12/2007 | Bessette | |
| 2008/0010064 | A1 | 1/2008 | Takeuchi et al. | |
| 2008/0031463 | A1 | 2/2008 | Davis | |
| 2008/0033731 | A1 | 2/2008 | Vinton et al. | |
| 2008/0126104 | A1 | 5/2008 | Seefeldt et al. | |
| 2008/0140393 | A1 | 6/2008 | Kim et al. | |
| 2010/0023336 | A1 | 1/2010 | Shmunk | |
| 2010/0286991 | A1 | 11/2010 | Hedelin et al. | |
| 2011/0035214 | A1 | 2/2011 | Morii | |
| 2011/0173012 | A1 | 7/2011 | Rettelbach et al. | |
| 2011/0178795 | A1 | 7/2011 | Bayer et al. | |
| 2011/0264454 | A1 | 10/2011 | Ullberg et al. | |
| 2012/0029924 | A1 | 2/2012 | Duni et al. | |
| 2012/0029925 | A1 | 2/2012 | Duni et al. | |
| 2013/0117028 | A1 | 5/2013 | Kim | |
| 2013/0218577 | A1 | 8/2013 | Taleb et al. | |

OTHER PUBLICATIONS

Valin, Jean-Marc, et al. "A high-quality speech and audio codec with less than 10-ms delay." Audio, Speech, and Language Processing, IEEE Transactions on 18.1 (2010): 58-67.*

International Searching Authority, International Search Report and Written Opinion Jun. 4, 2012 (PCT/US12/28120).

International Preliminary Report on Patentability dated Sep. 19, 2013 in PCT Application No. PCT/US2012/028114.

International Preliminary Report on Patentability dated Sep. 19, 2013 in PCT Application No. PCT/US2012/028120.

International Preliminary Report on Patentability dated Sep. 19, 2013 in PCT Application No. PCT/US2012/028124.

International Searching Authority, International Search Report and Written Opinion Feb. 2, 2012 (PCT/US11/52026).

International Searching Authority, International Search Report and Written Opinion May 30, 2012 (PCT/US12/28124).

International Searching Authority, International Search Report and Written Opinion Jun. 4, 2012 (PCT/US12/28114).

Valin et al. "A full-bandwidth audio codec with low complexity and very low delay." Proc. EUSIPCO, 2009.

Valin et al. "A high-quality speech and audio codec with less than 10-ms delay." Audio, Speech, and Language Processing, IEEE Transactions on 18.1 (2010): 58-67.

Valin et al. "Constrained-Energy Lapped Transform (CELT) Codec", IETF Internet Draft, July 4, 2009.

Kruger et al. "On Logarithmic spherical vector quantization." Information Theory and Its Applications, 2008. ISITA 2008. International Symposium on. IEEE, 2008.

* cited by examiner

DECODER 200

Rotations by $\varphi = \theta$ or $\pi/2-\theta$, *stride* $s=s_s$ *or* $s_l$

METHOD AND SYSTEM FOR TWO-STEP SPREADING FOR TONAL ARTIFACT AVOIDANCE IN AUDIO CODING

CROSS-REFERENCE TO RELATED APPLICATIONS

This application claims priority to provisional U.S. patent application No. 61/450,060, filed on Mar. 7, 2011 and entitled "Method and System for Two-Step Spreading for Tonal Artifact Avoidance in Audio Coding" which is incorporated herein in its entirety.

COPYRIGHT NOTICE

A portion of the disclosure of this patent document including any priority documents contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

One or more implementations relate generally to digital communications, and more specifically to eliminating quantization distortion in audio codecs.

INCORPORATION BY REFERENCE

The present application incorporates by reference U.S. Patent Application No. 61/384,154, which is assigned to the assignees of the present application.

BACKGROUND

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches.

The transmission and storage of computer data increasingly relies on the use of codecs (coder-decoders) to compress/decompress digital media files to reduce the file sizes to manageable sizes to optimize transmission bandwidth and memory use. Transform coding is a common type of data compression for data that reduces signal bandwidth through the elimination of certain information in the signal. Sub-band coding is a type of transform coding that breaks a signal into a number of different frequency bands and encodes each one independently as a first step in data compression for audio and video signals. Transform coding is typically lossy in that the output is of lower quality than the original input. Many present compression techniques fail to remedy problems associated with compression artifacts, which are noticeable distortion effects caused by the application of lossy data compression, such as pre-echo, warbling, or ringing in audio signals, or ghost images in video data.

Traditional sub-band audio codecs, such as MP3, use frequency transforms with very good frequency selectivity, such as MDCT (modified discrete cosine transform) operations. These codecs produce very compact representations of tonal signals, but atonal noise can be spread out into many bins, requiring a number of non-zero coefficients to represent this content. For low-bitrate audio coding, the high frequencies are often coded with very few bits, because they are generally perceptually less important than lower frequencies. Since these bands represent a disproportionately large range of frequencies, they cover a large number of transform coefficients, and any non-zero coefficients become very expensive to code in terms of bitrate. Often there are only enough bits for a relatively small number of non-zero coefficients, and the resulting coded signal can sound very tonal, even if the original input signal was not tonal. This can result in the creation of a type of distortion called "birdie" artifacts or musical noise. Birdie artifacts are common in low bitrate MP3 files and typically manifest as metallic tones that appear and disappear at random, and are mainly caused by quantizing the spectrum very coarsely, such that if there are many values in the spectrum that are random, only a few may end up being non-zero after quantization, creating noise that sounds like tones.

Current methods of reducing distortion caused by birdie artifacts include using low-pass filters to reduce the amount of signal to quantize. This approach however does not eliminate these artifacts if the effect is seen in the passband of the filter.

What is needed, therefore, is a method and system that more effectively eliminates birdie artifacts than provided in current audio coding systems.

BRIEF DESCRIPTION OF THE DRAWINGS

In the following drawings like reference numbers are used to refer to like elements. Although the following figures depict various examples, the one or more implementations are not limited to the examples depicted in the figures.

DETAILED DESCRIPTION

Embodiments are generally directed to systems and methods for coding digital audio that include mechanisms for dynamically spreading transform coefficients over multiple frequencies based on the available bitrate of an audio codec to reduce the overall tonality of the signal when there are only enough bits to code a relatively small number of non-zero coefficients. This helps to eliminate "birdie" artifacts and similar compression artifacts and replaces the artifacts with more natural sounding content. When the bitrate is increased, the magnitude of the spreading is reduced and the efficiency of the original frequency-selective transform for tonal signals is restored. The method includes a two-step process that can achieve a high degree of spreading using an invertible process with very low computational complexity. Additional side information gives the encoder further control over the degree of the spreading based on properties of the original signal, to allow the accurate representation of the input signal, which may happen to be very tonal in the high frequencies.

Any of the embodiments described herein may be used alone or together with one another in any combination. The one or more implementations encompassed within this specification may also include embodiments that are only partially mentioned or alluded to or are not mentioned or alluded to at all in this brief summary or in the abstract. Although various embodiments may have been motivated by various deficiencies with the prior art, which may be discussed or alluded to in one or more places in the specification, the embodiments do not necessarily address any of these deficiencies. In other words, different embodiments may address different deficiencies that may be discussed in the specification. Some embodiments may only partially address some deficiencies or just one deficiency that may be discussed in the specification, and some embodiments may not address any of these deficiencies.

Aspects of the one or more embodiments described herein may be implemented on one or more computers or processor-based devices executing software instructions. The computers may be networked in a peer-to-peer or other distributed computer network arrangement (e.g., client-server), and may be included as part of an audio and/or video processing and playback system.

Embodiments are directed to an audio coding scheme implemented in a codec (coder-decoder) system. The audio coding scheme operates on a spectrum and is invertible. In an overall process of the two-step coefficient spreading method, the spectrum of frequency coefficients is rotated based on a defined rotation angle, and is then quantized. The rotation transform operation is then reversed so that a previously sparse spectrum (i.e., one with mostly zero values) becomes one that has many non-zero values.

Figure 1:
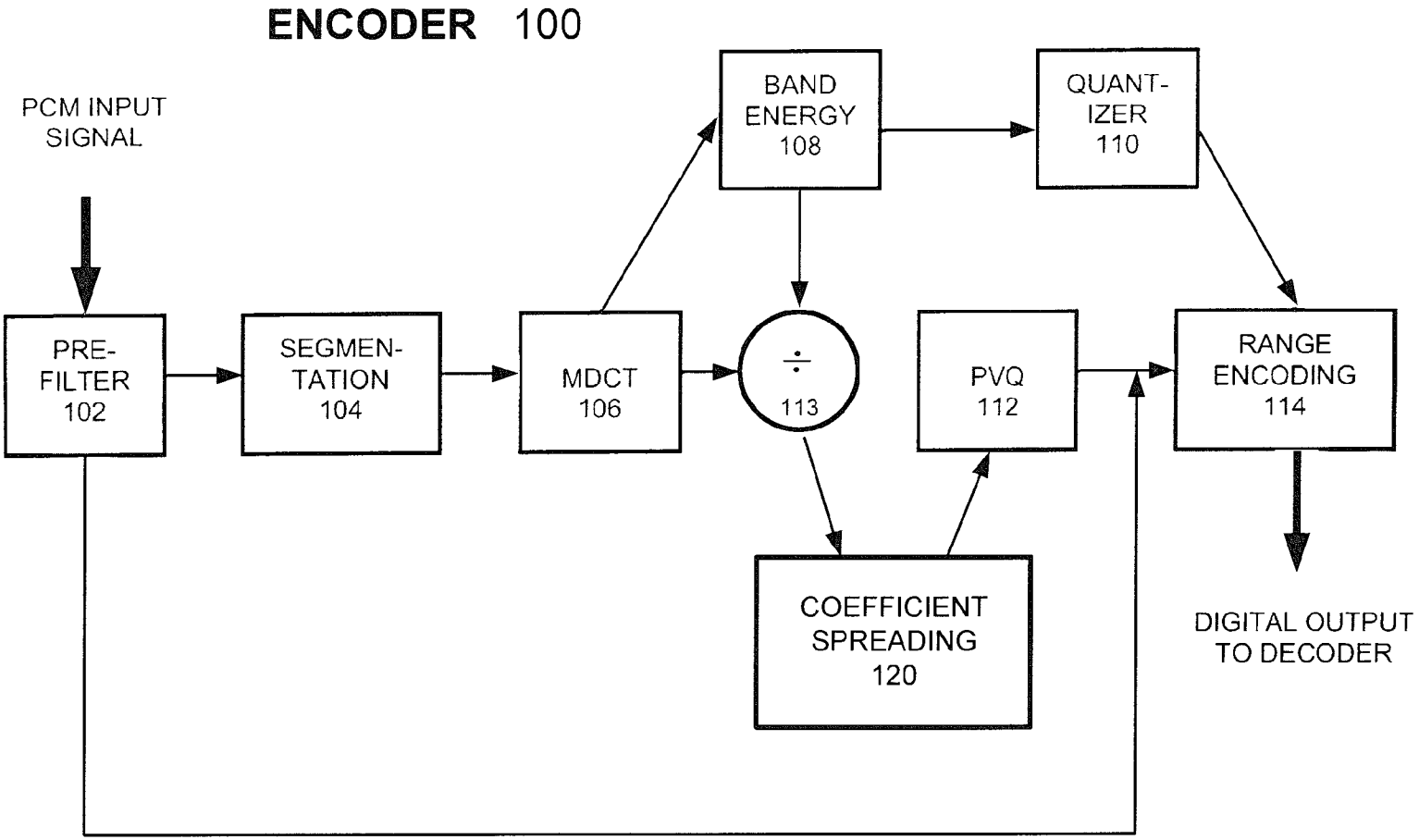
FIG. 1 is a block diagram of an encoder circuit for use in an audio coding system that includes a dynamic coefficient spreading mechanism, under an embodiment.

FIG. 1 is a block diagram of an encoder circuit for use in an audio coding system that includes a dynamic coefficient spreading mechanism, under an embodiment. The encoder 100 is a transform codec circuit based on the modified discrete cosine transform (MDCT) using a codebook for transform coefficients in the frequency domain. The input signal is a pulse-code modulated (PCM) signal that is input to a pre-filter stage 102. The PCM coded input signal is segmented into relatively small overlapping blocks by segmentation component 104. The block-segmented signal is input to the MDCT function block 106 and transformed to frequency coefficients through an MDCT function. Different block sizes can be selected depending on application requirements and constraints. For example, short block sizes allow for low latency, but may cause a decrease in frequency resolution. The frequency coefficients are grouped to resemble the critical bands of the human auditory system. The entire amount of energy of each group is analyzed in band energy component 108, and the values quantized in quantizer 110 for data reduction. The quantized energy values are compressed through prediction by transmitting only the difference to the predicted values (delta encoding). The unquantized band energy values are removed from the raw DCT coefficients (normalization) in function 113. The coefficients of the resulting residual signal (the so-called "band shape") are coded by Pyramid Vector Quantization (PVQ) block 112. PVQ is a form of spherical vector quantization using the lattice points of a pyramidal shape in multidimensional space as the quantizer codebook for quickly and efficiently quantizing Laplacian-like data, such as data generated by transforms or subband filters. This encoding process produces code words of fixed (predictable) length, which in turn enables robustness against bit errors and removes any need for entropy encoding. The output of the encoder is coded into a single bitstream by a range encoder 114. The bitstream output from the range encoder 114 is then transmitted to the decoder circuit.

In an embodiment, and in connection with the PVQ function 112, the encoder 100 uses a technique known as band folding, which delivers an effect similar to spectral band replication by reusing coefficients of lower bands for higher bands, while also reducing algorithmic delay and computational complexity.

Figure 2:
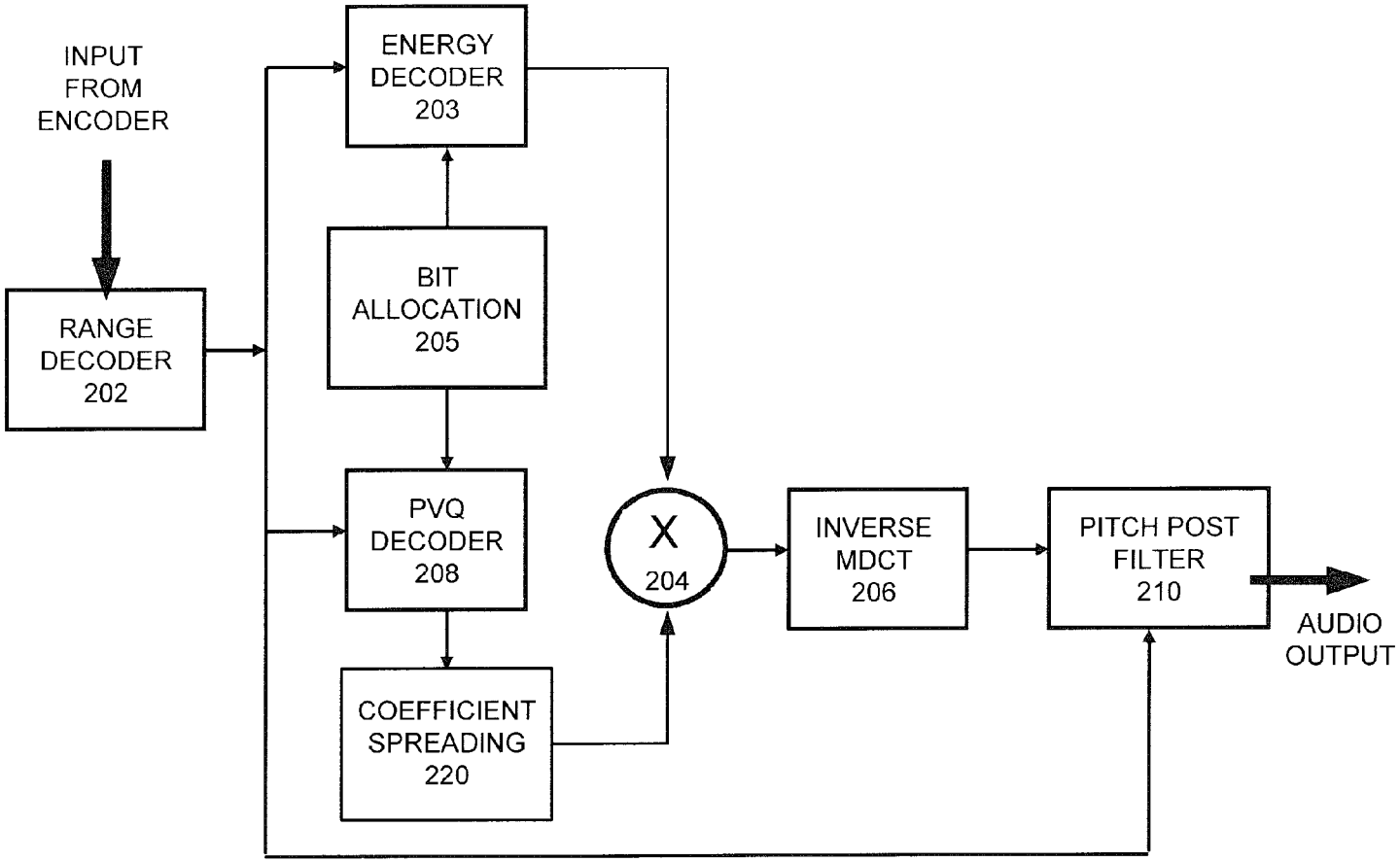
FIG. 2 is a block diagram of a decoder circuit for use in an audio coding system that includes a dynamic coefficient spreading mechanism, under an embodiment.

FIG. 2 is a block diagram of a decoder circuit for use in an audio coding system that includes a dynamic coefficient spreading mechanism, under an embodiment. The decoder 200 receives the encoded data from the encoder and processes the input signal through a range decoder 202. From the range decoder 202, the signal is passed through an energy decoder 203 and a PVQ decoder 208, and to pitch post filter 210. The values from PVQ decoder 208 are multiplied to the band shape coefficients by function 204, and then transformed back to PCM data through inverse MDCT function 206. The individual blocks may be rejoined using weighted overlap-add (WOLA) in folding block. Many parameters are not explicitly coded, but instead are reconstructed using the same functions as the encoder. The decoded signal is then processed through a pitch post filter 210 and output to an audio output circuit, such as audio speaker(s). In the embodiment of FIG. 2, a coefficient spreading function 220 provides coefficient spreading information that is combined with decoded energy values in function 204. A bit allocation block 205 provides bit allocation data to the energy decoder 203 and PVQ decoder 208. A similar bit allocation block may be provided on the encoder side between quantizer 110 and PVQ 112 for symmetry between the encoder and decoder.

In an embodiment, the codec represented by FIG. 1 and FIG. 2 may be an audio codec, such as the CELT (Constrained Energy Lapped Transform) codec developed by the Xiph.Org Foundation. It should be noted, however, that any similar codec might be used.

For the embodiment of FIGS. 1 and 2, an input audio signal is partitioned into (possibly overlapping) frames, each of which may contain one or more blocks that are mapped from the time domain into a set of frequency domain coefficients, using a transform function. This function may be either a transform with a fixed resolution across all frequencies, such as the Modified Discrete Cosine Transform (MDCT), or one with variable time-frequency (TF) resolution. An example of a variable time-frequency resolution scheme is described in U.S. Patent Application No. 61/384,154, which is hereby incorporated by reference in its entirety.

After transformation to the frequency domain, the frequency coefficients are grouped into a number of bands, whose size may vary to match properties of the human ear. This accounts for psycho acoustic effects associated with audio signal processing. Each band may further group coefficients into tiles, where each tile contains coefficients from that band corresponding to distinct periods of time. In general, a block encompasses data from a particular segment of time over all frequencies, and a band encompasses data from a particular set of frequencies over all the blocks in the frame. A tile comprises data from a particular segment of time and a particular set of frequencies.

In an embodiment, the basis functions corresponding to coefficients within an individual tile decay to zero or nearly zero outside of the time period that a particular tile corresponds to, in order to minimize their magnitude outside this period to avoid leakage and reduce the occurrence of pre-echo artifacts. The bands are then quantized, coded, and transmitted to a decoder. As part of the codebook used in the quantization process, different portions of the band may be coded explicitly. Other portions may be produced by a linear combination of the content of one or more prior bands (possibly requiring TF-resolution changes, such as described in U.S. Patent App. No. 61/384,154) if the number of tiles in the source band is not the same as the number of tiles in the band to which it is being copied. In an embodiment, certain portions of a band may be filled with pseudorandom noise.

Figure 3:
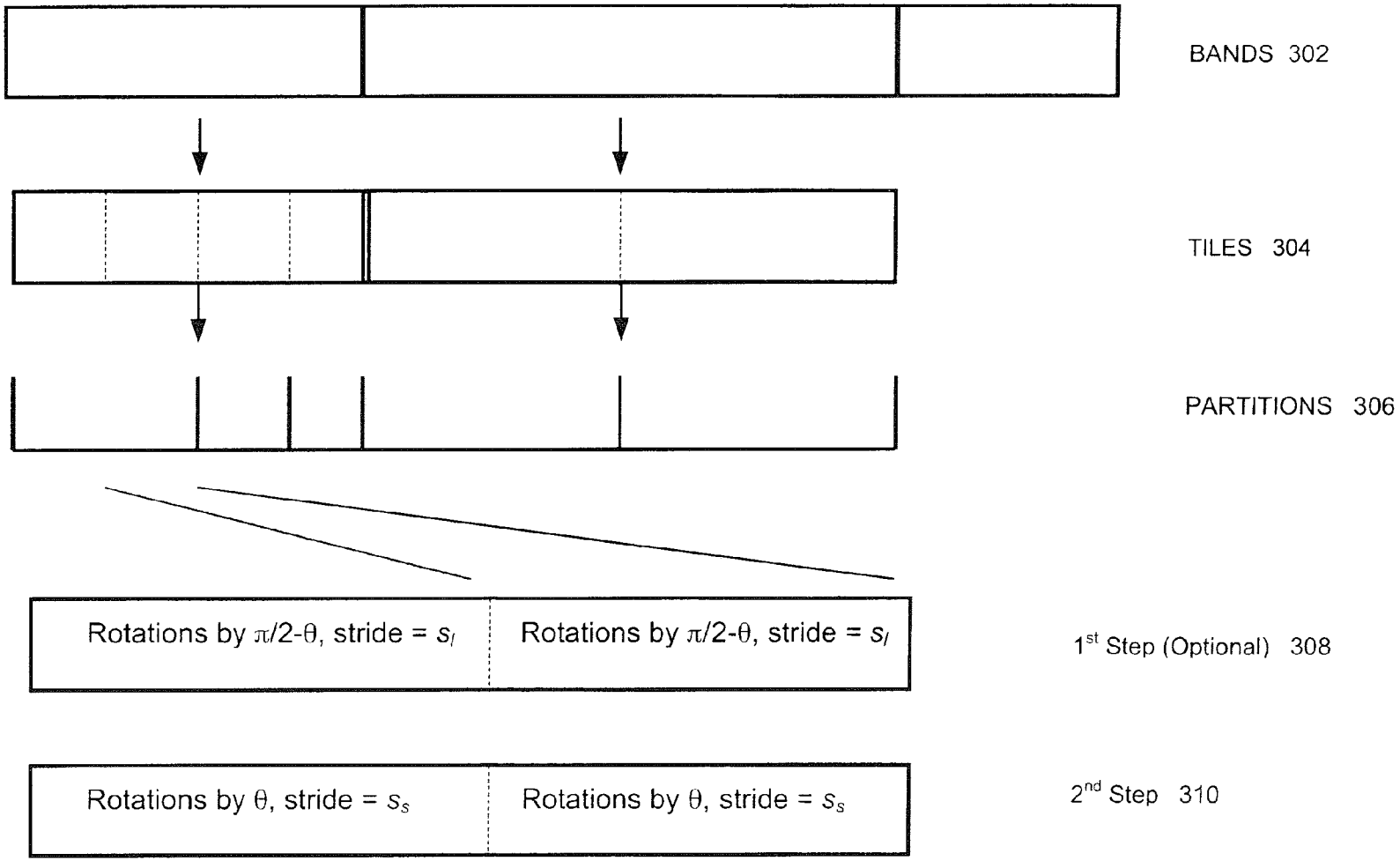
FIG. 3 is a diagram that illustrates the partitioning of audio bands into blocks and partitions for use with an audio coding system that features dynamic coefficient spreading, under an embodiment.

Due to memory and complexity issues, a band may be decomposed into one or more partitions, with each partition covering some subset of coefficients, which are coded as a single unit. FIG. 3 is a diagram that illustrates the partitioning of audio bands into tiles and partitions for use with an audio coding system that features dynamic coefficient spreading, under an embodiment. As shown in FIG. 3, the coefficients are grouped into a number of bands 302. One or more of the bands group their respective coefficients into tiles 304, such that each block contains coefficients from distinct periods of time. The bands are also split into one or more partitions 306. A partition usually spans some subset of the frequencies in a band, and may contain coefficients from multiple tiles. Each partition corresponds to a portion of a band at which an independent decision can be made to code it explicitly, use a linear combination of the content of other bands, or fill it with pseudorandom noise.

In an embodiment, a coefficient spreading process 220 in the decoder 200 applies a spreading process to each partition separately if the number of bits used to code the partition is sufficiently low, as compared to a defined threshold. A gain factor, g, is computed as some function of one or more of the following: the number of bits used to code the partition, the number of coefficients in the partition, the size of the codebook(s) used to code the coefficients, and other implied or coded side information, and any other suitable parameters. In a preferred embodiment, the gain starts out near one and approaches zero as the size of the codebook used to code the partition increases. In addition, there are three selectable levels of spreading, which are signaled once per audio frame, and a fourth level that disables spreading entirely. The spreading function may also be disabled once the number of bits used to code the partition is sufficiently high.

Figure 4:
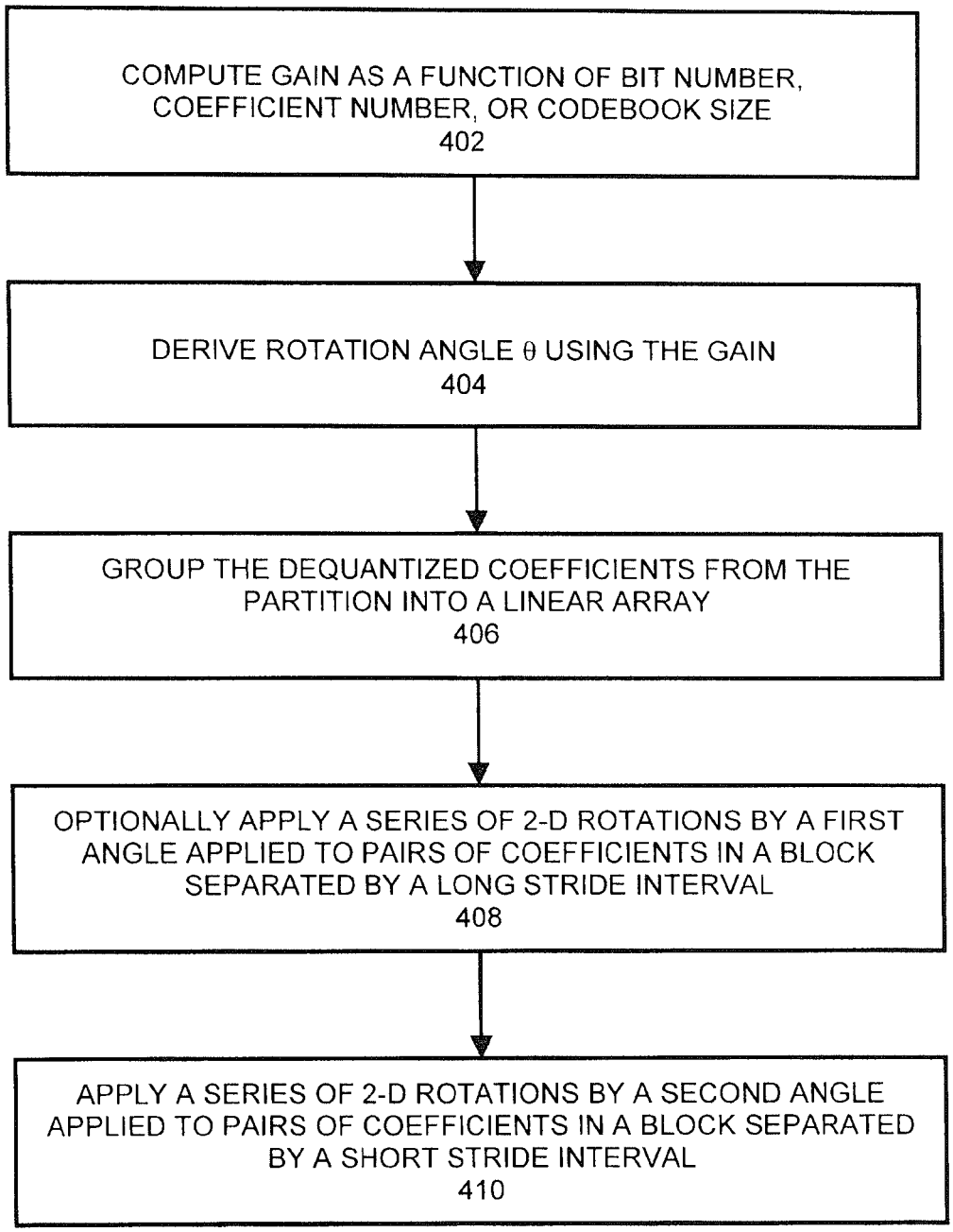
FIG. 4 is a flowchart that illustrates a method of performing coefficient spreading in an audio coding system, under an embodiment.

In partitions where the spreading function is enabled, a two-step spreading process proceeds as shown in FIG. 4. FIG. 4 is a flowchart that illustrates a method of performing coefficient spreading in an audio coding system, under an embodiment. The process begins in act 402 by computing the gain factor as a function of the number of bits to code the partition, the number of coefficients in the partition, and/or the size of the codebook, or any other relevant function, as described above. The gain is used to derive a rotation angle θ, with angles near π/4 implying more spreading and angles near zero implying less spreading, act 404. In a preferred embodiment, the rotation angle θ is determined from the gain g according to the following formula: $\theta=\pi/4\ g^2$.

The dequantized coefficients are then grouped into a linear array, act 406. These dequantized coefficients may be reordered so that all of the coefficients from a single tile are contiguous. Members of the contiguous array may be separated from each other by a distance referred to as a "stride" or "stride length" or "stride interval," with adjacent members being separated by a stride of 1. In an embodiment, each tile is processed independently in order to ensure that the spreading process does not introduce any pre-echo artifacts.

As shown in FIG. 4, the process includes an optional first rotation step, act 408, in which a series of two-dimensional (2-D) rotations by a first angle of π/2−θ is applied to successive pairs of coefficients in a tile separated by a "long stride" interval, $s_l$. In an embodiment, the long stride interval length is computed as:

$$s_l=\lfloor\sqrt{M}+\tfrac{1}{2}\rfloor$$

where M is the number of coefficients from the current tile in the partition.

This optional first rotation step may be omitted if M is too small, i.e., smaller than a defined threshold number of coefficients. In an example implementation, the first step is omitted if M<8.

The process then proceeds with a second rotation step, act 410, in which a series of 2-D rotations by a second angle of θ is applied to successive pairs of coefficients in a tile separated by a "short stride" interval, $s_s$. In an embodiment, the short stride interval length is always equal to one.

The rotations of the coefficient pairs by the angle θ in act 410 decay most quickly when θ is near zero, and decay more slowly as θ approaches π/4. For large bands, small amounts of spreading decay relatively quickly, only affecting a few nearby coefficients. By contrast, successive rotations by the first angle π/2−θ in the optional first rotation step decay more slowly when θ is near zero, and decay more quickly as θ approaches π/4. The combination of these two rotation steps thus allows for efficient, controlled spreading even in a large band, producing a relatively flat floor regardless of the amount of spreading employed.

Figure 5:
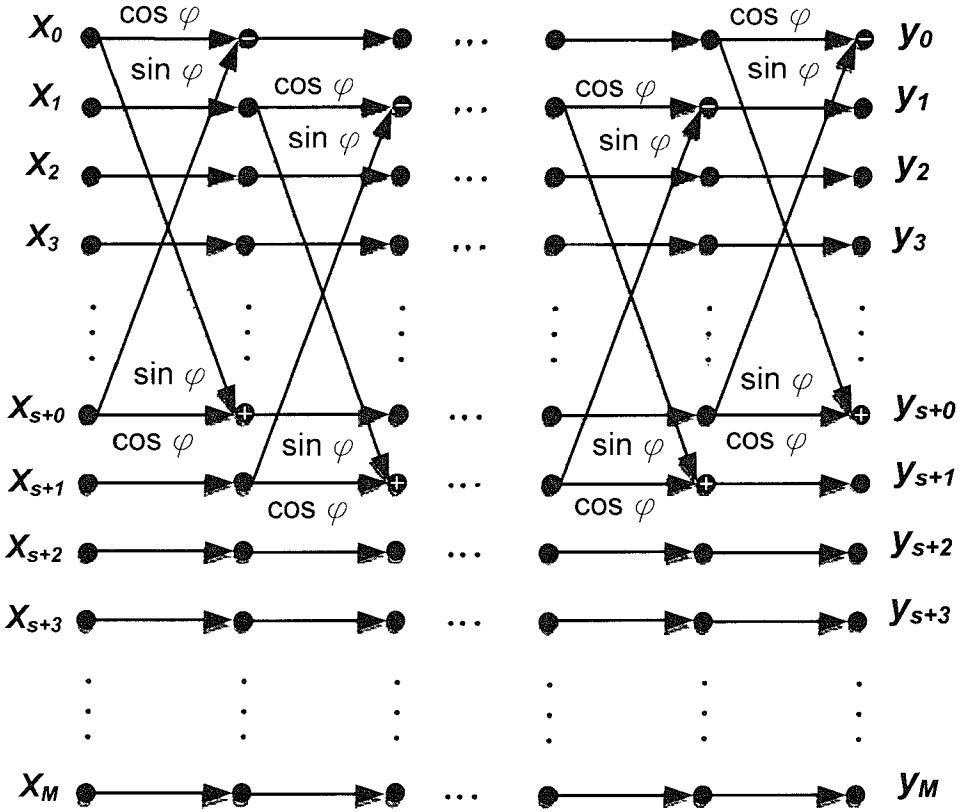
FIG. 5 is a diagram that illustrates rotations of coefficient pairs by two different angles and two different stride intervals in a coefficient spreading method, under an embodiment.

FIG. 5 is a diagram that illustrates rotations of coefficient pairs by two different angles and two different stride intervals in a coefficient spreading method, under an embodiment. The rotation operation operates on a spectrum containing N-points assumed to lie in a plane. Successive overlapping pairs of points are rotated relative to each other, and the stride interval (long stride versus short stride) determines how far apart the pairs of points are from one another. Thus, in a base case (e.g., short stride interval=1), rotations may be applied to pairs of points: {1 and 2, 2 and 3, 3 and 4, . . . , N−1 and N} (N-1 and N−2, N−3 and N−2 . . . , 2 and 1). In a long-stride rotation scheme, the rotations are applied to pairs of points that are separated by a specific interval length. In an example case, rotations may be applied to pairs of points: {1 and 9, 3 and 11, N−8 and N}, and so on. In the base case, the rotation angle is typically between 0 and π/4, while in the second case, the rotation angle is typically between π/2 and π/4.

If two rotation steps are applied, they may be applied by the decoder in any order, that is, as a long stride rotation followed by short stride rotation, or short stride rotation followed by long stride rotation. The encoder will then perform the inverse of these operations in reverse order. In general, an optional series of rotations is the one that has the long stride, and in an embodiment, the series with the short stride (adjacent coefficients) is the one that is always performed.

The coefficient spreading process uses a series of orthonormal transformations, and is thus invertible. In an embodiment, these orthonormal transformations are implemented in a decoder-side coefficient spreading component 220 in decoder 200. Thus, with reference to FIG. 4, at least acts 406, 408, and 410 are performed in the coefficient spreading component 220 of decoder 200. The encoder 100 includes a encoder-side coefficient spreading component 120 that applies a reverse process to the coefficients before quantization and coding. Thus, if the decoder applies two sets of rotations, such as a long stride at a first angle and a short stride at a second angle, the encoder will perform the reverse functions of the short stride at the second angle then the long stride at the first angle. This allows the encoder to better approximate the input signal, and helps to ensure perfect reconstruction in the absence of quantization.

For purposes of the present description, the terms "component," "module," and "process," may be used interchangeably to refer to a processing unit that performs a particular function and that may be implemented through computer program code (software), digital or analog circuitry, computer firmware, or any combination thereof.

It should be noted that the various functions disclosed herein may be described using any number of combinations of hardware, firmware, and/or as data and/or instructions embodied in various machine-readable or computer-readable media, in terms of their behavioral, register transfer, logic component, and/or other characteristics. Computer-readable media in which such formatted data and/or instructions may be embodied include, but are not limited to, physical (non-transitory), non-volatile storage media in various forms, such as optical, magnetic or semiconductor storage media.

Embodiments are directed to a method and system of transforming a first spectrum having few non-zero values into a spectrum having a large number of non-zero values, the sparse spectrum including a number N of points lying in a plane, with the method comprising: defining, in a processor-based device, a rotation angle for rotating successive pairs of points of the first spectrum, wherein the rotation angle is between $\pi/4$ and $\pi/2$; applying a first rotation operation using the rotation angle on a first set of successive pairs of points, wherein members of each pair of points of the first set of successive pairs of points are separated by a first stride length; and applying a second rotation operation using a second rotation angle on a different set of successive pairs of points, wherein members of each pair of points of the different set of successive pairs of points are separated by a second stride length.

Embodiments are also directed to a method and system of coding an audio signal in an audio coding system comprising a decoder circuit coupled to an encoder circuit, with the method comprising: grouping frequency domain coefficients generated by a transform function performed on an input audio signal into a plurality of partitions, wherein each partition spans some subset of frequencies in a band, and wherein each partition is coded by the processor-based device using a defined number of bits, and further wherein the frequency domain coefficients are coded using one or more codebooks; arranging the coefficients for a first partition into a linear array; computing a gain factor for the bits of first partition; deriving a rotation angle for successive pairs of coefficients of the linear array based on the gain factor, wherein the rotation angle is between $\pi/4$ and $\pi/2$; and applying one or more rotation operations to successive pairs of coefficients in the linear array using a defined rotation angle and a defined stride length for each rotation operation of the one or more rotation operations, wherein the one or more rotation operations includes a rotation operation in which the defined stride length is greater than a unity distance between members of the successive pairs of coefficients.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

While one or more implementations have been described by way of example and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A method of transforming a first spectrum having few non-zero values into a spectrum having a large number of non-zero values, the sparse spectrum including a number N of points lying in a plane, the method comprising:

defining, by a processor-based device, a rotation angle for rotating successive pairs of points of the first spectrum, wherein the rotation angle is between $\pi/4$ and $\pi/2$, the processor-based device being executed on a computer having a non-transitory computer readable medium storing a plurality of instructions executable by one or more processors;

applying, by the processor-based device, a first rotation operation using the rotation angle on a first set of successive pairs of points, wherein members of each pair of points of the first set of successive pairs of points are separated by a first stride length; and applying, by the processor-based device, a second rotation operation using a second rotation angle on a different set of successive pairs of points, wherein members of each pair of points of the different set of successive pairs of points are separated by a second stride length.

2. The method of claim 1 wherein the processor-based device comprises part of an audio codec applying an invertible transform operation, and wherein the first rotation operation is performed before the second rotation operation in a first audio coding session, and wherein the second rotation operation is performed before the first rotation operation in an alternate audio coding session.

3. The method of claim 1 wherein the first stride length is a short stride that is set to a unity distance value between the members of the each pairs of points.

4. The method of claim 3 wherein the second stride length is a long stride that is an integer multiple of the unity distance value.

5. The method of claim 4 wherein the processor-based device comprises an audio coding system including a decoder stage functionally coupled to an encoder stage, and wherein the points of the spectrum comprise frequency domain coefficients generated by a transform function performed on an input audio signal.

6. The method of claim 5 further comprising organizing the frequency domain coefficients into partitions within a band, wherein each partition spans some subset of frequencies in a band, and wherein each partition is coded by the processor-based device using a defined number of bits, and further wherein the frequency domain coefficients are coded using one or more codebooks.

7. The method of claim 6 further comprising computing a gain factor as a function of at least one of: the number of bits, a number of coefficients in a defined partition, and a size of the one or more codebooks.

8. The method of claim 7 wherein the rotation angle is a function of the gain factor and is calculated by squaring the gain factor and multiplying by $\pi/4$.

9. The method of claim 8 wherein the second stride length is a function of the number of coefficients in the defined partition and is calculated by taking the square root of the number of coefficients and adding the value ½.

10. The method of claim 9 wherein the first operation method is omitted in the case where the number of coefficients in the defined partition is less than eight.

11. A method of coding an audio signal in an audio coding system comprising a decoder circuit coupled to an encoder circuit, the method comprising:

grouping frequency domain coefficients generated by a transform function performed on an input audio signal into a plurality of partitions, wherein each partition spans some subset of frequencies in a band, and wherein each partition is coded by the processor-based device using a defined number of bits, and further wherein the frequency domain coefficients are coded using one or more codebooks;

arranging the coefficients for a first partition into a linear array;

computing a gain factor for the bits of first partition;

deriving a rotation angle for successive pairs of coefficients of the linear array based on the gain factor, wherein the rotation angle is between $\pi/4$ and $\pi/2$; and applying one or more rotation operations to successive pairs of coefficients in the linear array using a defined rotation angle and a defined stride length for each rotation operation of the one or more rotation operations, wherein the one or more rotation operations includes a rotation operation in which the defined stride length is a unity distance between members of the successive pairs of coefficients.

12. The method of claim 11 wherein the gain factor is computed as a function of at least one of: the number of bits, a number of coefficients in a defined partition, and a size of the one or more codebooks.

13. The method of claim 12 wherein the rotation angle is a function of the gain factor as calculated by the squaring the gain factor and multiplying by $\pi/4$.

14. The method of claim 12 wherein the one or more rotation operations comprise:

applying a first rotation operation using the rotation angle on a first set of successive pairs of points of the linear array, wherein members of each pair of points of the first set of successive pairs of points are separated by a first stride length; and applying a second rotation operation using a second rotation angle on a different set of successive pairs of points of the linear array, wherein members of each pair of points of the different set of successive pairs of points are separated by a second stride length.

15. The method of claim 14 wherein the first stride length is a short stride that is set to a unity distance value between the members of the each pairs of points, and the second stride length is a long stride that is an integer multiple of the unity distance value.

16. The method of claim 15 wherein the second stride length is a function of the number of coefficients in the first partition.

17. The method of claim 11 wherein only one rotation operation is applied to the successive pairs of coefficients in the linear array in the case where the number of coefficients in the first partition is less than eight.

18. A system for coding an audio signal, comprising:

a first decoder component in a decoder circuit grouping frequency domain coefficients generated by a transform function performed on an input audio signal into a plurality of partitions, wherein each partition spans some subset of frequencies in a band, and wherein each partition is coded by the processor-based device using a defined number of bits, and further wherein the frequency domain coefficients are coded using one or more codebooks;

a second decoder component arranging the coefficients for a first partition into a linear array, computing a gain factor for the bits of first partition; and a first coefficient spreading function executed by the decoder component and deriving a rotation angle for successive pairs of coefficients of the linear array based on the gain factor, wherein the rotation angle is between $\pi/4$ and $\pi/2$, and applying one or more rotation operations to successive pairs of coefficients in the linear array using a defined rotation angle and a defined stride length for each rotation operation of the one or more rotation operations, wherein the one or more rotation operations includes a rotation operation in which the defined stride length is a unity distance between members of the successive pairs of coefficients.

19. The system of claim 18 wherein the gain factor is computed as a function of at least one of: the number of bits, a number of coefficients in a defined partition, and a size of the one or more codebooks, and wherein the rotation angle is a function of the gain factor as calculated by the squaring the gain factor and multiplying by $\pi/4$.

20. The system of claim 19 wherein the one or more rotation operations comprise:

applying a first rotation operation using the rotation angle on a first set of successive pairs of points of the linear array, wherein members of each pair of points of the first set of successive pairs of points are separated by a first stride length; and applying a second rotation operation using a second rotation angle on a different set of successive pairs of points of the linear array, wherein members of each pair of points of the different set of successive pairs of points are separated by a second stride length.

21. The system of claim 20 wherein the first stride length is a short stride that is set to a unity distance value between the members of the each pairs of points, and the second stride length is a long stride that is an integer multiple of the unity distance value, and that is a function of the number of coefficients in the first partition.

22. The system of claim 21 further comprising an audio codec including an encoder circuit coupled to the decoder circuit wherein the audio codec applying an invertible transform operation, and wherein encoder circuit performs one or more reverse rotation operations corresponding to the one or more rotation operations performed in the decoder circuit and in an order opposite to an order performed in the decoder circuit.

* * * * *